US005520793A

United States Patent [19]

Genders et al.

[11] Patent Number: 5,520,793

[45] Date of Patent: May 28, 1996

[54] METHODS OF PRODUCING HYDROGEN IODIDE ELECTROCHEMICALLY

[75] Inventors: J. David Genders, Marilla; Norman L. Weinberg, East Amherst; Dan M. Hartsough, Clarence, all of N.Y.

[73] Assignee: Benham Electrosynthesis Company, Inc., Oklahoma City, Okla.

[21] Appl. No.: 415,700

[22] Filed: Apr. 3, 1995

[51] Int. Cl.[6] ..... C25B 1/00

[52] U.S. Cl. ..... 205/464; 204/450

[58] Field of Search ..... 204/101, 103, 204/82, 180.1, DIG. 4

[56] References Cited

U.S. PATENT DOCUMENTS

| | | | |
|---|---|---|---|
| 3,681,213 | 8/1972 | Heit | 204/82 |
| 3,726,937 | 4/1973 | Stepanov | 204/128 |
| 4,053,376 | 10/1977 | Carlin | 204/103 |
| 4,147,601 | 4/1979 | Carlin | 204/103 |
| 4,203,813 | 5/1980 | Grantham | 204/103 |
| 4,218,301 | 8/1980 | Grantham | 204/251 |
| 4,320,179 | 3/1982 | Hart | 429/15 |
| 4,687,565 | 8/1987 | Hirakata | 204/258 |
| 4,818,637 | 4/1989 | Molter | 429/15 |
| 5,423,960 | 6/1995 | Vaughan | 204/103 |

OTHER PUBLICATIONS

L. Pauling, General Chemistry, W H Freeman & Co. (1970) Month unavailable.

Remy, H., Treatise On Inorganic Chemistry: Elsevier Publishing Co., (1956) p. 780 Month unavailable.

Faith, W. L. et al; Industrial Chemicals, Third ed., John Wiley & Sons; (1965); pp. 466–467 Month unavailable.

*Primary Examiner*—John Niebling
*Assistant Examiner*—Brendan Mee
*Attorney, Agent, or Firm*—Howard M. Ellis

[57] ABSTRACT

Improved electrochemical processes for producing high purity grades of hydrogen iodide without developing cell fouling iodine solids through oxidation of iodide at the anode back migrating through ion exchange membrane into anolyte compartment. Two and three compartment electrochemical cells have anolyte solutions with chemical agents for oxidizing back migrating iodides to soluble iodine species to avoid build up of iodine solids on key cell components. Other embodiments include processes with undivided electrochemical cells fitted with hydrogen depolarized anodes, optionally operating electrogeneratively producing at least some of its own power requirements while simultaneously producing HI, or processes of making high purity HI with multi-phase aqueous/non-aqueous anolytes for solubilizing iodine solids as they develop in the anolyte compartment.

35 Claims, 3 Drawing Sheets

METHODS OF PRODUCING HYDROGEN IODIDE ELECTROCHEMICALLY

TECHNICAL FIELD

This invention relates generally to methods for making hydrogen iodide, and more specifically to improved methods of making high purity hydrogen iodide electrochemically.

BACKGROUND OF THE INVENTION

Hydrogen iodide is widely used as a source of iodine in agricultural, pharmaceutical and industrial applications. The earliest methods of producing hydrogen iodide were by chemical means in which iodine ($I_2$) was reduced with various chemical reagents, including hydrazine. Aqueous solutions of hydrogen iodide were generally prepared by the reaction of hydrogen and iodine over platinum catalysts or by the reaction of hydrogen sulfide and iodine in water. The chemical routes for manufacturing HI were not only costly and hazardous, but often produced toxic by-products and did not provide grades of sufficient purity for food, pharmaceutical, photographic applications, and so on.

In 1977, Carlin first disclosed in U.S. Pat. No. 4,053,376 an alternative process for preparing aqueous solutions of hydrogen iodide by electrochemical means, thus providing the potential for HI grades of higher purity. The Carlin method provides for electrolyzing solutions of iodine in the catholyte compartment of an electrolytic cell equipped with a permselective ion exchange membrane. The anolyte compartment is filled with an aqueous solution comprising an electrolyte, such as an acid to provide a supply of protons. With the application of a voltage across the anode and cathode iodine is reduced to iodide at the cathode. Protons from the anolyte compartment pass through the membrane and into the catholyte compartment where they react with the iodide ions to form solutions containing in excess of 40 weight percent hydrogen iodide.

While the electrochemical methods of Carlin provided some fundamental improvements in the production of higher purity grades of hydrogen iodide, the present inventors discovered that naturally occurring inefficiencies in membranes of the type disclosed by Carlin can severely impede cell performance. That is, while permselective cation exchange type membranes, for example, allow selectively protons and other positively charged ions to pass from one cell compartment through the membrane to the adjacent compartment, membrane inefficiencies allow small, but significant amounts of negatively charged anions, such as iodide ions produced at the cathode to back migrate from the catholyte compartment through the membrane and enter the anolyte compartment. There, iodide ions having a negative charge are attracted by the positive charge of the anode. Iodide ions reaching the anode undergo oxidation, and in so doing give up electrons to the electron deficient anode to form elemental iodine ($I_2$).

Because of the crystalline solid properties and low solubility of iodine, after a relatively short period of cell operation, iodine solids collect and plate out on the anode, ion exchange membrane, other key cell components and in the piping of the cell. Within a short time period the precipitation and accumulation of iodine crystals in the anolyte compartment interferes with cell performance. It was found that fouling of the cell with solid elemental iodine impedes solution flow, impedes transmission of protons through the membrane from the anolyte to the catholyte compartments and increases cell internal resistance (iR loss) producing higher cell voltages and greater power consumption.

For similar reasons, the electrochemical methods of Carlin did not always provide the desired higher purity grades of HI produced in the catholyte compartment. In this regard, U.S. Pat. No. 4,053,376 teaches an anolyte liquor in the form of an acidic aqueous solution containing, for example, sulfuric acid, hydrochloric acid or phosphoric acid. For the same membrane inefficiencies discussed above, some unwanted anions in the anolyte compartment, e.g., sulfate, chloride and phosphate back migrate into the catholyte compartment and contaminate the aqueous HI-containing catholyte. Consequently, it was also found that the purity of the aqueous solutions of hydrogen iodide produced by this earlier electrochemical method was compromised.

Accordingly, there is need for improved more efficient electrochemical processes for producing hydrogen iodide without the co-production of cell fouling iodine solids, and one which produces consistently higher purity grades of hydrogen iodide without introducing unwanted contaminants during production.

SUMMARY OF THE INVENTION

In accordance with the invention improved methods are provided for the electrochemical synthesis of hydrogen halides generally, including such species as hydrogen bromide, and more particularly, hydrogen iodide at higher concentrations such that problems of migration of undesirable anions from the anolyte to the catholyte, e.g., sulfate, chloride, phosphate, etc., are avoided, along with the oxidation of iodide ions at the anode and concomitant deposition of iodine solids and fouling of key electrochemical cell components, as well as piping.

It is thus a principal object of the invention to provide an improved method of producing hydrogen iodide electrochemically by the steps of:

(i) providing a compartmentalized electrochemical cell having an anode in an anolyte compartment and a cathode in a catholyte compartment;

(ii) introducing into the catholyte compartment an aqueous electrolyte comprising solubilized iodine;

(iii) introducing into the anolyte compartment an aqueous solution comprising an oxidizing agent in an amount at least sufficient to chemically oxidize back migrating iodide ions produced in the catholyte compartment to a soluble iodine species;

(iv) impressing a voltage across the anode and cathode to produce at least protons in the anolyte compartment and hydrogen iodide in the catholyte compartment.

It is also an objective of the invention to produce at least one useful product at the anode selected from the group consisting of periodic acid, oxygen and protons. Iodic acid may also be formed in solution by an indirect electrochemical process, but might also be formed to some extent directly at the anode.

The aqueous anolyte solution of step (iii), which is preferably acidic includes an "oxidizing agent" which is intended to denote any chemical oxidizing agent suitable for oxidizing iodide ions back migrating through a compartmentalizing cell divider, e.g., permselective ion exchange membrane, from the catholyte compartment to react therewith to form iodate ($IO_3^-$) and/or periodate ions ($IO_4^-$), and preferably does so without introducing undesirable foreign anions, e.g. sulfate, phosphate, etc., or foreign cations, e.g., sodium or potassium, into the process having the potential for contaminating the catholyte by back migrating or passing through the cell divider from the anolyte compartment. Representative examples of suitable "oxidizing agents" include such members as halogenated oxidizing acids, non-halogenated peracids, hydrogen peroxide, ozone, and mixtures of the same. Thus, the expression "soluble iodine species" as recited in step (iii) is intended to denote principally iodate and periodate ions in solution as their respective acids.

The present inventors discovered the potential for reactions occurring in which any iodide ions which back migrate into the anolyte compartment become oxidized at the anode to form iodine solids, can be significantly reduced in concentration by chemical oxidation reactions. Hence, the invention contemplates as one principal embodiment the electrochemical synthesis of higher purity hydrogen iodide solutions, which includes chemical oxidation reactions with back migrating iodide ions in aqueous anolyte liquors having non-contaminating chemical oxidizing agents.

It is yet a further object of the invention to not only produce high purity grades of hydrogen iodide by the reduction of iodine at the cathode, but also to conduct a useful process at the anode simultaneously. This would include, for example, the production of protons by oxidation of hydrogen at the anode. Such protons are especially useful because they readily pass through a cation exchange membrane separating the anolyte and catholyte compartments and react with iodide ions to form hydrogen iodide.

Likewise, a further representative example of a useful anode process would be the electrochemical synthesis of periodic acid, which is also a preferred non-contaminating chemical oxidizing agent which can be generated at the anode by oxidation of iodic acid. Iodic acid chemically oxidizes back migrating iodide in the anolyte compartment to iodine intermediate which is further oxidized by periodic acid to iodic acid. Hence the anolyte usually requires only an initial charge of iodic and/or periodic acids at the time of cell start-up. Iodic and periodic acids are further generated in-situ by chemical and electrochemical reactions taking place in the anolyte compartment. Oxidizing agents, in general, may be added only as an initial charge, or periodically or continuously depending largely on the rate of back migration of iodide ions.

It is yet a further object of the invention to provide a method for making high purity hydrogen halides, and particularly hydrogen iodide in a compartmentalized electrochemical cell, usually a cell having two compartments in which the anode is a hydrogen consuming type, i.e. hydrogen depolarized anode. In operating an electrochemical cell having a hydrogen diffusion electrode hydrogen gas is oxidized at the anode to provide a readily available supply of protons for reacting with the iodide-containing catholyte.

It is still a further object of the invention to provide batch, continuous and semi-continuous processes for the electrochemical synthesis of high purity hydrogen halides, and particularly hydrogen iodide. In this regard, the continuous mode can be performed by the steps of distilling HI from the catholyte liquor, and condensing the vapor to form a distillate rich in HI. The continuous and semi-continuous mode can also be conducted by the steps of removing all or a portion of the solution of HI from the catholyte of a compartmentalized electrochemical cell, and further electrolyzing in a secondary polishing cell to convert a substantial portion of the residual solubilized iodine to HI.

It is still a further object of the invention to provide alternative cell configurations including those wherein the permselective ion exchange membrane and the cell anode are integral with one another forming a so called solid polymer electrolyte composite.

Other related methods of producing hydrogen iodide electrochemically contemplated by the invention include those having more than two cell compartments performed by the steps of:

(i) providing, e.g., a three compartment electrochemical cell having an anode in an anolyte compartment, a cathode in a catholyte compartment, and a central compartment disposed between the anolyte and catholyte compartments, the electrochemical cell has a cation exchange membrane separating the anolyte and central compartments and a anion exchange membrane separating the catholyte and central compartments;

(ii) introducing into the catholyte compartment an aqueous solution comprising solubilized iodine;

(iii) introducing into the anolyte compartment an aqueous solution comprising an oxidizing agent;

(iv) introducing into the central compartment an aqueous solution of an electrolyte comprising HI, and (v) impressing a voltage across the anode and cathode to produce iodide ions at the cathode and protons at the anode, the iodide ions from the catholyte and protons from the anolyte passing through their respective membranes into the central compartment to form high purity hydrogen iodide.

Alternative methods for production of hydrogen halides in multi-compartment, i.e., more than two compartment electrochemical cells, include processes performed by the steps of:

(i) providing a three compartment electrochemical cell having an anode in an anolyte compartment, a cathode in a catholyte compartment, and a central compartment disposed between the anolyte and catholyte compartments, the anolyte and catholyte compartments being separated from the central compartment by first and second spaced cation exchange membranes;

(ii) introducing into the catholyte compartment an aqueous electrolyte solution comprising solubilized iodine;

(iii) introducing into the anolyte compartment an aqueous solution comprising an acidic electrolyte;

(iv) introducing into the central compartment an aqueous electrolyte solution comprising HI, and (v) impressing a voltage across the anode and cathode to produce iodide ions at the cathode and protons at the anode, the protons passing through the first cation exchange membrane into the central compartment and through the second cation exchange membrane into the catholyte compartment to react with the iodide ions therein to form high purity hydrogen iodide.

In the above method protons enter the central compartment from the anolyte compartment and are transported from the central compartment into the catholyte compartment. In addition, any back migrating iodide ions from the catholyte compartment enter the central compartment forming a flush solution of HI. This HI flush solution in the central compartment is maintained at a lower concentration than the concentration of iodide ions in the catholyte compartment. This limits the transmission of iodide ions from the central compartment to the anolyte compartment.

Other alternative embodiments for the electrochemical synthesis of hydrogen halides, such as HI include processes performed with an undivided or divided electrochemical cell and a hydrogen consuming anode. The process can be performed by the steps of:

(i) providing an electrochemical cell having a cathode and a hydrogen depolarized anode;

(ii) introducing into the electrochemical cell an electrolyte comprising solubilized iodine;

(iii) providing a voltage source for said anode and cathode to produce iodide ions at the cathode, and (iv) feeding a source of hydrogen to the hydrogen depolarized anode to form protons for reacting with the iodide ions.

An advantage in using a hydrogen depolarized anode is that with highly dispersed reactive catalysts, such as platinum the cell may be operated at very low cell voltages or electrogeneratively, i.e., without an external source of electricity, wherein the anode and cathode are electrically shorted enabling the production of hydrogen iodide and other useful products with the simultaneous production of electricity. Accordingly, in this embodiment the cell is capable of producing at least a portion of its own electrical power requirements. In another embodiment a cell with a hydrogen depolarized anode is operating in a divided cell mode with a cation exchange membrane.

A still further alternative embodiment for the electrochemical synthesis of hydrogen halides, such as HI according to the invention includes the steps of:

(i) providing a membrane divided electrochemical cell having an anode in an anolyte compartment and a cathode in a catholyte compartment;

(ii) introducing into the catholyte compartment an aqueous electrolyte comprising solubilized iodine;

(iii) introducing into the anolyte compartment a liquid comprising an aqueous phase and a nonaqueous phase having an electrochemically stable, iodine solubilizing organic solvent;

(iv) impressing a voltage across the anode and cathode to produce iodide ions at the cathode and protons at the anode, and (v) forming hydrogen iodide in the catholyte compartment from protons from the anolyte compartment passing through the membrane and reacting with iodide ions. Any iodine solids forming in the anolyte compartment are readily dissolved in the iodine solubilizing organic solvent without deposition on cell and other components.

The organic solvent of the non-aqueous phase in the anolyte compartment is preferably a halogenated organic solvent, such as methylene dichloride, ethylene dichloride, trichloroethylene, and so on, including mixtures of the same.

BRIEF DESCRIPTION OF THE DRAWINGS

For a further understanding of the invention and its characterizing features reference should now be made to the accompanying drawings wherein.

DESCRIPTION OF THE PREFERRED EMBODIMENTS

Figure 1:
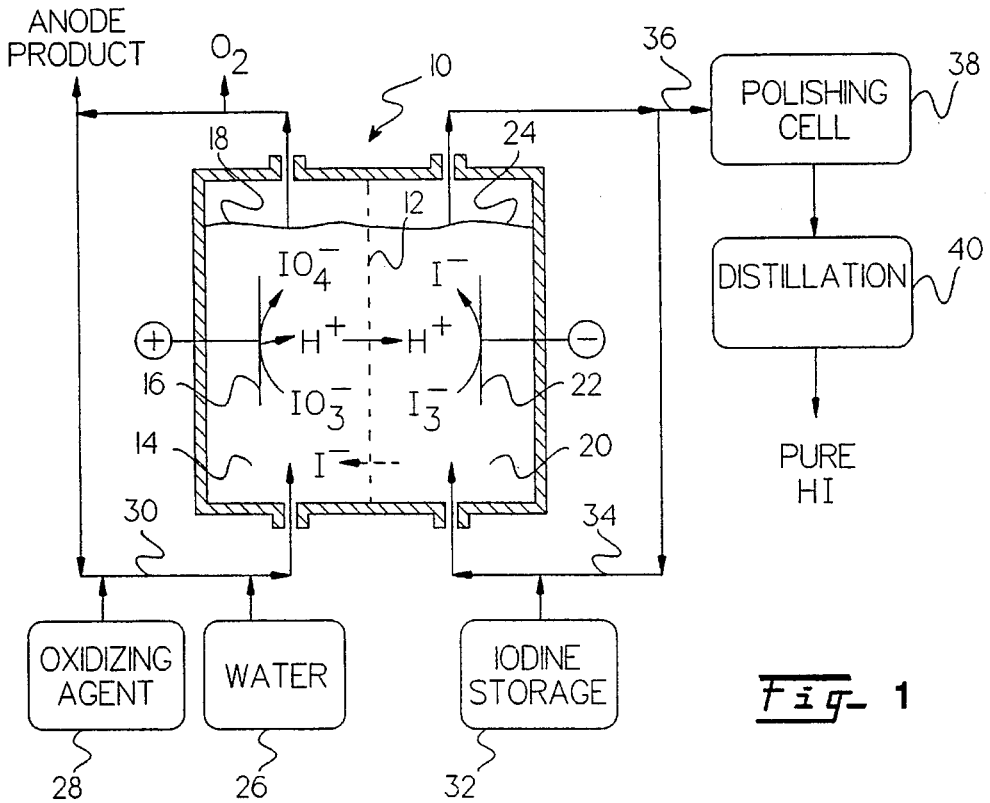
FIG. 1 is a diagrammatic view of a preferred system for the electrochemical synthesis of high purity hydrogen iodide according to the invention employing a two compartment membrane divided cell.

Turning first to FIG. 1 there is shown electrochemical cell 10 compartmentalized by means of a cell divider 12 which is preferably a stable permselective ion exchange membrane. While a stable porous diaphragm, such as a microporous Teflon® or porous asbestos separator can be used, it is less preferred. Cell divider 12 separates the interior of the electrolyzer into dual compartments: a first compartment or anolyte compartment 14 housing an anode 16 and an anolyte liquor or electrolyte 18; and a second compartment or catholyte compartment 20 for housing a cathode 22 and a catholyte liquor or electrolyte 24.

Most preferably, the cell divider 12 of FIG. 1 is a cationic type permselective membrane which permits positively charged ions, such as protons produced at anode 16 to readily transfer through the membrane from anolyte compartment 14 to the catholyte compartment 20. Similarly, negatively charged anions, such as iodide produced at cathode 22, remain principally in the catholyte compartment. Notwithstanding, inherent inefficiencies in membrane performance allow relatively small, but nevertheless significant amounts of iodide or triiodide ($I_3^-$) produced by reduction of solubilized iodine at the cathode, to back migrate from catholyte compartment 20 through membrane 12 to anolyte compartment 14.

Iodide ions back migrating through the membrane and into the anolyte compartment under ordinary circumstances would become oxidized at the anode, give up electrons and precipitate out as iodine solids to foul key cell components and eventually cause cell shut down. The present invention is able to overcome this problem inter-alia by introducing into anolyte liquor 18 an aqueous solution of a chemical oxidizing agent 28. That includes any chemical oxidizing agent suitable for oxidizing any back migrating iodide ions produced in the catholyte compartment to soluble iodine species, such as iodate ions, and in so doing bypass formation of cell fouling iodine solids in the anolyte compartment.

Suitable oxidizing agents include members selected from the group consisting of halogenated oxidizing acids, non-halogenated peracids, hydrogen peroxide, ozone and mixtures of the same. Representative halogenated oxidizing acids include iodic acid, periodic acid, bromic acid, chloric acid, perchloric acid and mixtures thereof. Most preferred oxidizing acids are iodic acid, periodic acid and mixtures of the two. Representative examples of non-halogenated peracids include persulfuric acid and peracetic acid. Iodic and periodic acids are especially preferred when highest purity hydrogen iodide is desired, since other foreign ions introduced into the anolyte, such as chloride can back migrate through the cation exchange membrane, enter the catholyte compartment and appear as an unwanted contaminant in the aqueous hydrogen iodide catholyte product.

Iodic and periodic acids are especially preferred oxidizing agents and electrolytes for the anolyte liquor. But for small amounts of makeup oxidant added to the anolyte liquor as a result of back migration of iodate ion into the catholyte compartment, in practice iodic acid need only be added to the anolyte liquor at cell start up. Any iodate or periodate ions diffusing into the catholyte compartment will react with iodide to form iodine which will be subsequently reduced at the cathode to iodide ion. Hence, no foreign anions are introduced into the process with use of iodic and periodic acids, permitting the production of ACS low phosphate grade HI.

The concentration of oxidizing agents in the anolyte compartment range generally from about 0.001M up to saturation, and more specifically from about 0.01M to just below saturation. Concentrations are chosen such that preferably no precipitate of iodine or oxidizing agent forms in the anolyte compartment. The soluble iodine concentration in the catholyte will vary from a high of near saturation at the outset of a batch process, and most preferably, as close to zero as possible at the completion of the run. The HI concentration in the catholyte is chosen to be such that all iodine added to the catholyte is preferably solubilized. Depending on the desired HI product concentration after electrolysis, HI concentration can be as low as about 0.1% up to about 65% or greater. Most frequently, commercial grades of HI are in the range of about 40 to 60% by weight HI.

Cathode current density generally ranges from about 1 $mA/cm^2$ to 1000 $mA/cm^2$, and more specifically from about 10 to 500 $mA/cm^2$, and more preferably from about 50 to 300 $mA/cm^2$. Catholyte temperature may generally range from about just above the freezing point of the solution to its boiling point, and more preferably from about 15° C. to the boiling point of the solution.

Iodate ions undergo electrochemical oxidation at the anode to form periodate ions. Other important reactions occurring in the anolyte compartment include iodate or periodate ions chemically oxidizing back migrating iodide ions to iodine as a transient intermediate, which is very quickly oxidized by the periodate ion produced at the anode to regenerate useful iodate ions. Accordingly, as long as the anode is forming periodate ions at a rate sufficient to oxidize back migrating iodide ions to iodate ions no iodine solids will form at the anode or in the anolyte liquor. Some of the chemical reactions as they are believed to be occurring in the anolyte are shown below:

$$IO_3^- + 5I^- + 6H^+ \rightarrow 3H_2O + 3I_2$$

$$IO_4^- + 7I^- + 8H^+ \rightarrow 4H_2O + 4I_2$$

$$I_2 + H_2O + 5IO_4^- \rightarrow 7IO_3^- + 2H^+$$

Periodic acid produced at the anode is a commercially valuable end product of electrolysis, as are its salts, such as sodium, potassium and calcium periodates. The latter are formed by neutralization of periodic acid, for example, by the corresponding hydroxide. Hence, two valuable cell products may be formed simultaneously, namely aqueous HI and aqueous $HIO_4$, thereby sharing capital and operating costs, such that the manufacturing cost of each is improved.

As previously mentioned, the invention contemplates generation of at least one useful product at the anode. That is, in addition to periodic acid generated at the anode during the process, protons are needed in the production of HI. One major source of protons is through the electrolysis of water at the anode. A secondary source of protons would be from the electrochemical oxidation of iodate at the anode in the formation of periodate. Those anode reactions are shown below:

$$2H_2O \rightarrow 4H^+ + O_2\uparrow + 4e$$

$$IO_3^- + H_2O \rightarrow IO_4^- + 2H^+ + 2e$$

The principal reaction at the cathode consists of the reduction of iodine to form iodide ions. Because of the very limited solubility of elemental iodine in aqueous solutions the iodine can be solubilized by dissolving in a solution containing soluble iodides through the formation of principally the triiodide ion ($I_3^-$). The preferred source of soluble iodides would be a solution containing hydrogen iodide. Solutions of soluble salts can also be employed. However, the introduction of a foreign cation could effectively reduce the purity of the HI catholyte and increase the concentration of contaminants in the final product. Hence, the catholyte liquor per se after cell start up will contain sufficient soluble iodide ions in solution as a current carrying electrolyte and as a solubilizer for iodine being added as make up. The initial catholyte feed at cell start up can have added hydrogen iodide.

Anodes of the electrochemical cells may be practically any of those commonly used in electrochemical synthesis processes. In selecting an anode the objective is to employ one capable of producing at least the minimum amount of oxidizing acid required to convert iodide ions to iodate or periodate ions. Representative examples of useful anodes would include those generally known as, noble metal anodes, dimensionally stable anodes, graphite-containing anodes, substoichiometric titanium oxide-containing anodes and lead oxide-containing anodes. More specific representative examples include platinized titanium noble metal anodes; anodes available under the trademark DSA-$O_2$ anodes, a dimensionally stable anode with iridium oxide oxygen evolving catalyst available under the trademark TIR 2000 from Electrode Corporation, Cleveland, Ohio, and solid graphite bi-dimensional anodes available from The Electrosynthesis Co, Inc., Lancaster, N.Y., under the designation "GR-12". Other anode materials comprise substoichiometric titanium oxides, and particularly the so called Magneli phase titanium oxides having the formula $TiO_x$ wherein x ranges from about 1.67 to about 1.9. A preferred specie of substoichiometric titanium oxide is $Ti_4O_7$. Magneli phase titanium oxides and methods of manufacture are described in U.S. Pat. No. 4,422,917 (Hayfield) which teachings are incorporated-by-reference herein. They are also commercially available under the trademark Ebonex®. These may have noble metal coatings to increase electrolysis, for example, for oxidation of iodate to periodate. Composite hydrogen consuming anodes are alternative anodes for noncompartmentalized cell operation. They are described in greater detail below.

Generally, cathodes may be bi-dimensional solid plate electrodes, or high surface area three dimensional types. High surface area cathodes, such as those comprised of stable metals, e.g., titanium, Raney nickel, lead, etc., and carbons are especially preferred in converting iodine to very low levels in the catholyte at high current density and high current efficiency. In the electrochemical synthesis of HI, cathodes are preferably comprised of carbon, such as solid planar bi-dimensional graphite plate, high surface area graphite felts and packed beds of graphite particles, the latter two providing superior performance in converting residual solubilized iodine to low levels. A representative commercially available solid bi-dimensional graphite-containing cathode would be the ATJ carbon cathode from Union Carbide Corp. Preferred three dimensional high surface area graphite felt cathodes are commercially available from The Electrosynthesis Company, Inc., Lancaster, N.Y., under the designation GF-S6. Particulate bed cathodes could, for example, be made of pulverized graphite plate. By the term "carbon" is meant electrically conductive forms of carbon, including more amorphous as well as graphitic forms. Electrically conductive composites of carbon, such as carbon-polymer and carbon-metal fiber composites are also included.

The electrochemical cells of the present invention may be monopolar or bipolar in design. The cells are preferably equipped with ion-exchange permselective type membranes, but may also be operated with porous diaphragm type separators, and in some instances, as will be discussed in greater detail below, operated successfully in an undivided or non-compartmented configuration without either a membrane or porous diaphragm. A broad range of inert materials commercially available based on microporous thin films of polyethylene, polypropylene, polyvinylidenedifluoride, polyvinyl chloride, polytetrafluoroethylene (PTFE), polymer-asbestos blends and so on, are useful as porous diaphragms. When the anolyte and catholyte compartments are separated by a porous diaphragm hydrostatic pressure on the solution in the anolyte compartment can be increased, or hydrostatic pressure on the solution in the catholyte compartment decreased. This will minimize the undesirable potential for back migration of anions, e.g., iodide ions, from the catholyte compartment passing through micropores in the cell separator and entering the anolyte compartment.

Useful cationic and anionic type permselective membranes are commercially available from many manufacturers and suppliers, including such companies as RAI Research Corp., Hauppauge, N.Y., under the trademark Raipore; E. I. DuPont under the trademark Nafion®, as well as from Tokuyama Soda, Asahi Glass, and others. Generally, those membranes which are fluorinated are most preferred in the production of hydrogen halides because of their overall stability to the corrosive and oxidative environment of the cell. An especially useful class of permselective ion exchange membranes are the perfluorosulfonic acid membranes, such as those available from E. I. DuPont under the trademark Nafion®. One particularly preferred example of a cationic permselective membrane is Nafion 350 which is a perfluoro-sulfonic acid membrane reinforced with embedded PTFE mesh. This particular grade of Nafion also restricts anion back migration.

The present invention also contemplates membranes and electrodes formed into solid polymer electrolyte composites. That is, at least one of the electrodes, either anode or cathode or both anode and cathode, are bonded to the ion exchange membrane forming an integral component.

FIG. 1 illustrates a two compartment membrane divided electrolysis cell system for production of high purity hydrogen iodide by either batch, semi-continuous or continuous modes of production. Anolyte liquor 18 consisting of an aqueous solution of iodic acid and/or periodic acid is derived from water supply 26 and iodic acid and/or periodic acid supply 28 fed to the anolyte compartment 14 via anolyte loop 30 to oxidize back-migrating iodide ions from the catholyte compartment to form soluble iodine species. Iodine supply 32 enters catholyte compartment 20 via catholyte loop 34 where it is solubilized by the presence of iodide ion to form soluble triiodide ion. A voltage is applied to the anode and cathode to oxidize iodate ions in the anolyte liquor to periodate ions. Simultaneously, water in the anolyte liquor is electrolyzed to form other useful products at anode 16 in addition to periodate, namely oxygen and protons. Optionally, anode products, such as periodic acid can be removed from anolyte loop 30 as makeup water is added to anolyte compartment 14. The catholyte can be withdrawn for recycling in catholyte loop 34 and further electrolyzed until the residual unreacted iodine in the catholyte is at a sufficiently low level whereupon the aqueous HI can be withdrawn from the cell and used as is. Optionally, the aqueous HI can be further purified in a continuous process by withdrawing a supply from a slip stream 36 where it is further treated in polishing cell 38. Cell 38 comprises the same fundamental components as electrochemical cell 10. However, the cathode of the polishing cell is preferably a high surface area cathode of the types previously discussed. As a further option, the slip stream may be purified in distillation unit 40 of conventional design. The invention also contemplates as a further option, chemical treatment of HI slip stream 36 with small amounts of hydrazine to further reduce residual solubilized iodine after completion of electrolysis.

Figure 2:
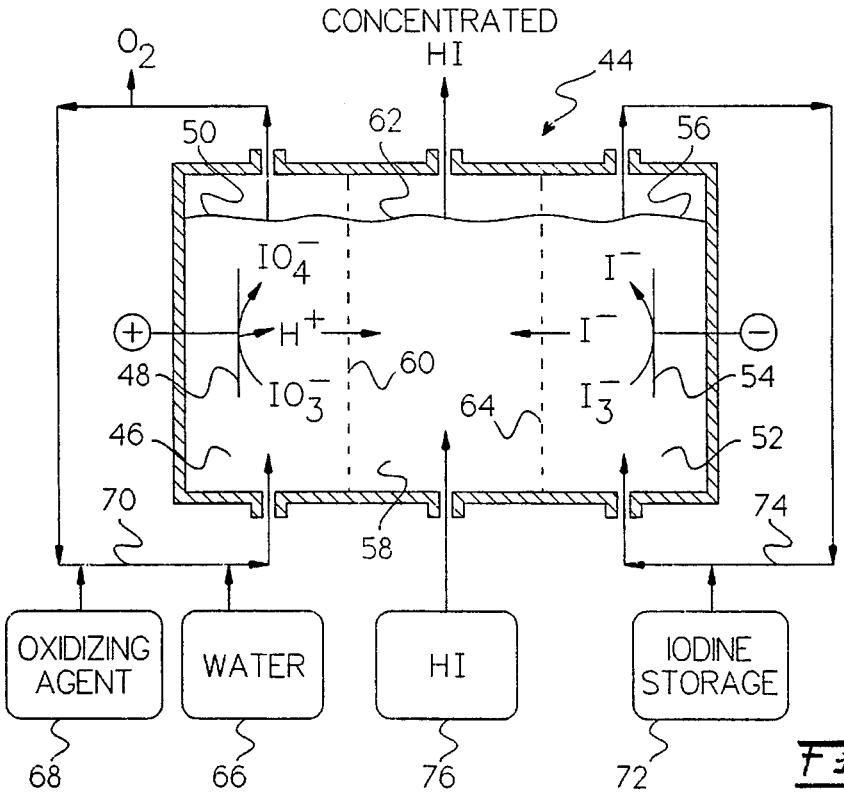
FIG. 2 is also a diagrammatic view of an alternative preferred system for the electrochemical synthesis of high purity hydrogen iodide employing a three compartment membrane divided cell.

FIG. 2 illustrates an alternative embodiment for the production of high purity hydrogen iodide. Instead of a two compartment membrane divided cell according to FIG. 1, the system of FIG. 2 employs a three compartment electrolytic cell 44 for operation by either batch, semi-continuous or continuous mode. Anolyte compartment 46 houses an anode 48 and an anolyte liquor 50, typically an aqueous solution of an oxidizing agent, e.g., iodic acid, which oxidizes any back migrating iodide ions to soluble iodine species while also performing as a current carrying electrolyte. Catholyte compartment 52 houses a cathode 54 and contains a catholyte liquor 56 consisting of an aqueous solution of solubilized iodine, e.g., hydrogen triiodide for electrolytic reduction to iodide ions at the cathode.

Between anolyte compartment 46 and catholyte compartment 52 is a central compartment 58 separated on one side from the anolyte compartment by means of a cationic permselective type membrane 60. Membrane 60 readily permits the transmission of protons produced at anode 48 to aqueous solution 62 containing a current carrying specie(s) like HI in the central compartment while restricting the transmission of anions between such compartments. A stable anion exchange membrane 64, such as available under the trademark Neosepta ACM or AMI (Tokayama, Inc.) and Tosoh Corp. fluorinated membranes, situated between central compartment 58 and catholyte compartment 52, readily permits the transmission of iodide ions formed at cathode 54 to aqueous solution 62 in central compartment 58 while limiting back migration of cations to the catholyte compartment.

Water supply 66 and oxidizing acid supply 68 are fed to anolyte loop 70 for circulation into anolyte compartment 46. In addition to the production of protons at the anode, oxygen is also produced through electrolysis of the aqueous anolyte solution. Optionally, periodic acid can be removed at the anolyte loop as makeup water is added to the anolyte liquor. Iodine supply 72 is metered into catholyte loop 74 for the catholyte liquor 56 where it is solubilized principally to hydrogen triiodide for reduction at cathode 54 to iodide ions, which in turn are transported across the anion exchange membrane into the central compartment where they combine with protons to form aqueous HI. Aqueous HI-containing solution 62 is removed from the central compartment and held in storage vessel 76 for recycling back to the central compartment until the HI concentration in the compartment reaches the desired level. It is desirable to maintain the concentration of solubilized iodine in the catholyte compartment at sufficiently low levels to minimize its transport into the central compartment.

Figure 3:
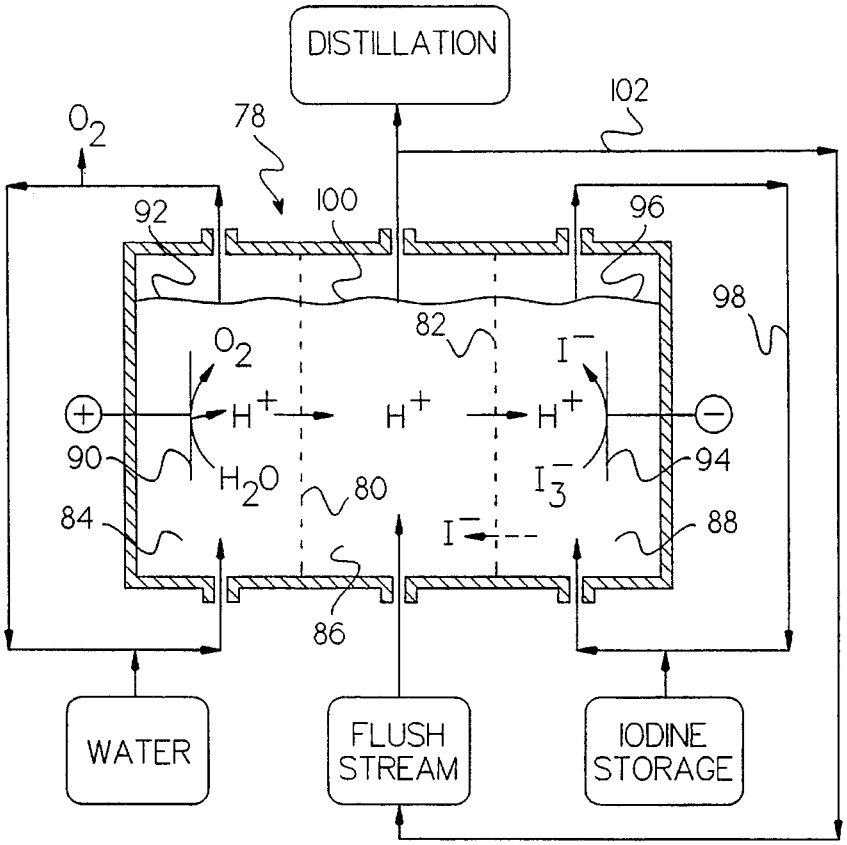
FIG. 3 is alternative embodiment of a system for producing high purity hydrogen iodide employing a three compartment membrane divided electrochemical cell similar to the type disclosed by FIG. 2.

FIG. 3 represents a further system for the production of high purity hydrogen iodide also employing a three compartment type electrolytic cell 78. The system is similar in many respects to the embodiment of FIG. 2, except that both ion exchange permselective membranes 80 and 82 separating anolyte compartment 84 from central compartment 86 and catholyte compartment 88 from central compartment 86 are cationic types. Because both membranes 80 and 82 are cationic types protons produced at anode 90 are transported from the anolyte liquor 92 to central compartment 86 and into catholyte compartment 88 to combine with iodide ions produced at cathode 94. The HI-containing catholyte 96 is circulated outside the cell through catholyte loop 98 and recycled back to the catholyte compartment until the desired concentration of aqueous HI is reached. Anolyte liquor 92 comprises an acid electrolyte which may be virtually any oxidizing or non-oxidizing acid, such as sulfuric, hydrochloric, phosphoric, iodic, periodic, and so on.

Central compartment 86 contains a dilute hydrogen iodide flush stream 100 in which back migrating iodide ions from the catholyte compartment form HI by combining with protons from the anolyte compartment moving to the catholyte compartment. In order to minimize the back migration of iodide ions from central compartment 86 to anolyte compartment 84 the concentration of HI in the HI flush stream 100 is maintained at a lower concentration than the HI concentration in the catholyte compartment. To maintain a low concentration of HI in flush stream 100 solution from the central compartment is recirculated in a central compartment loop 102 where a portion of the recycle is distilled for removal and recovery of HI values.

Dual cation exchange membranes and use of a flush solution in the central compartment minimizes back migration of foreign ions into the anolyte and catholyte compartments, so as to permit the use of non-oxidizing acids in the anolyte.

Figure 4:
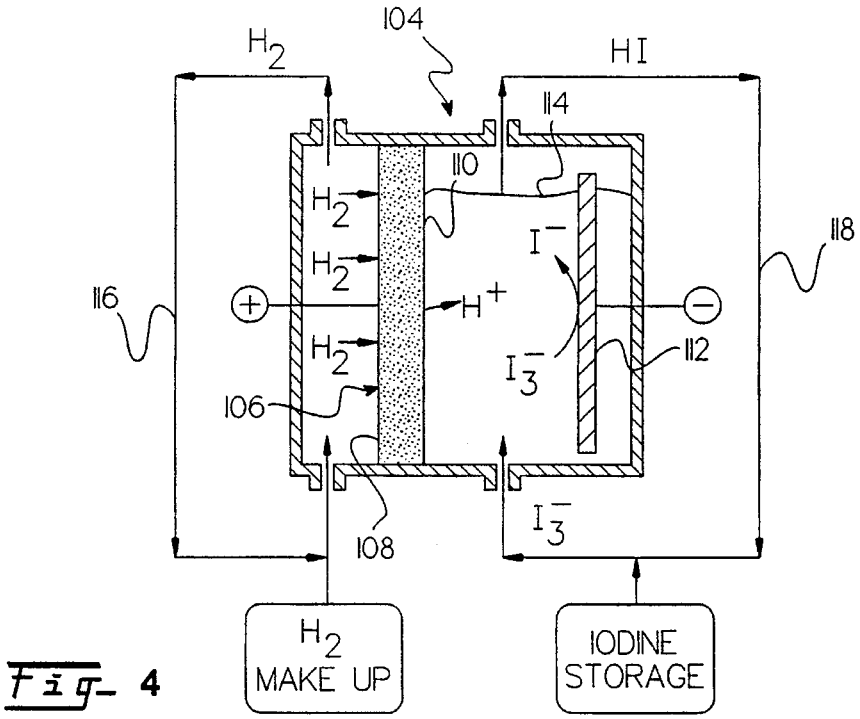
FIG. 4 is also a diagrammatic view of an alternative embodiment of the invention for the electrochemical synthesis of high purity hydrogen iodide employing a system with a single compartment undivided cell.

FIG. 4 demonstrates a further important embodiment of the invention with a single compartment, undivided electrolysis cell system for production of high purity hydrogen iodide by either batch, semi-continuous or continuous modes. Electrolytic cell 104 relies on use of hydrogen depolarized anode 106, instead of non-gas consuming electrodes disclosed in connection with other embodiments of the invention. While other electrolytic cells of the invention, such as the type disclosed by FIG. 1 can utilize a hydrogen consuming anode, the embodiment of FIG. 4 allows for the omission of the usual ion exchange membrane or other type of cell separator. This can be economically advantageous in allowing for lower capital costs and potentially lower operating cell voltages for reduced power consumption.

Hydrogen diffusion anode 106 is a known article of manufacture and is commercially available through ordinary channels of commerce. Gas diffusion electrodes of this type are recognized by various interchangeable names such as hydrogen depolarized anode, hydrogen consuming anode, hydrogen breathing anode, and so on. Regardless of the preferred name designation used, it is intended to denote the same type of electrode. Differences which may exist between such electrodes are primarily compositional and structural.

For example, suitable gas diffusion anodes for use in the cell systems of this invention are intended generally to mean porous electrode structures constructed as homogeneous composites; heterogeneous layered-laminated composite-like structures, and the like. Because they are porous in nature such electrodes have a dry side 108 to which hydrogen gas is fed, and a wet or anolyte liquor side 110. Internally, hydrogen depolarized anodes can be characterized as having a three-phase interface formed of gas (hydrogen), electrolyte solution and electrode material.

Compositionally, hydrogen consuming anode 106 may contain a corrosion stable, electrically conductive base support comprised of a carbon, such as carbon black or substoichiometric titanium oxides like $Ti_4O_7$, mixed with a nonconductive hydrophobic polymer like Teflon® or polyolefin fibers. In addition, the gas consuming anodes of the invention can also contain an electrocatalyst for aiding in electrochemical dissociation of hydrogen at the anode. Representative electrocatalysts may be comprised of highly dispersed metals or alloys of the platinum group metals, such as platinum, palladium, ruthenium, rhodium and iridium; known electrocatalytic metal oxides, organometallic macrocyclic compounds, and other electrocatalysts well known in the fuel cell art for electrochemical dissociation of hydrogen.

While the above description of hydrogen consuming electrodes relates principally to porous homogeneous composite structures, for purposes of this invention such electrodes are also intended to include heterogeneous, layered type composite structures wherein each layer may have a distinct physical and compositional makeup, e.g., porosity and hydrophobic polymer base to prevent flooding, for instance, and loss of the three phase interface, and resulting electrode performance.

The hydrogen depolarized electrodes 106 may have porous polymeric layers on or adjacent to the anolyte liquor side (wet side) 110 of the anode to assist in decreasing penetration and electrode fouling. Stable polymeric resins or films are included in a composite electrode layer on the wet side. Representative examples of resin include those formed from non-ionic polymers, such as Teflon®, polystyrene, polyvinyl chloride, polysulfone, etc., or ionic-type charged polymers like those formed from polystyrenesulfonic acid, sulfonated copolymers of styrene and vinylbenzene, carboxylated polymer derivatives, sulfonated or carboxylated polymers having partially or totally fluorinated hydrocarbon chains and aminated polymers like polyvinylpyridine. Stable microporous polymer films may also be applied on dry side 108 to inhibit electrolyte penetration.

Cathode 112 is of the type previously discussed. Aqueous electrolyte 114 comprises a solubilized solution of iodine, i.e., hydrogen triiodide. Hydrogen is introduced into the back or dry side of the hydrogen depolarized anode 106 where the hydrogen is oxidized in the electrode interface to form protons which combine with iodide ions formed at the cathode. Hydrogen is recycled through loop 116 where makeup hydrogen can be added. Similarly, HI-containing catholyte is withdrawn and recycled via catholyte loop 118 back to cell 104 for further electrolysis until the desired concentration of HI is reached.

Figure 5:
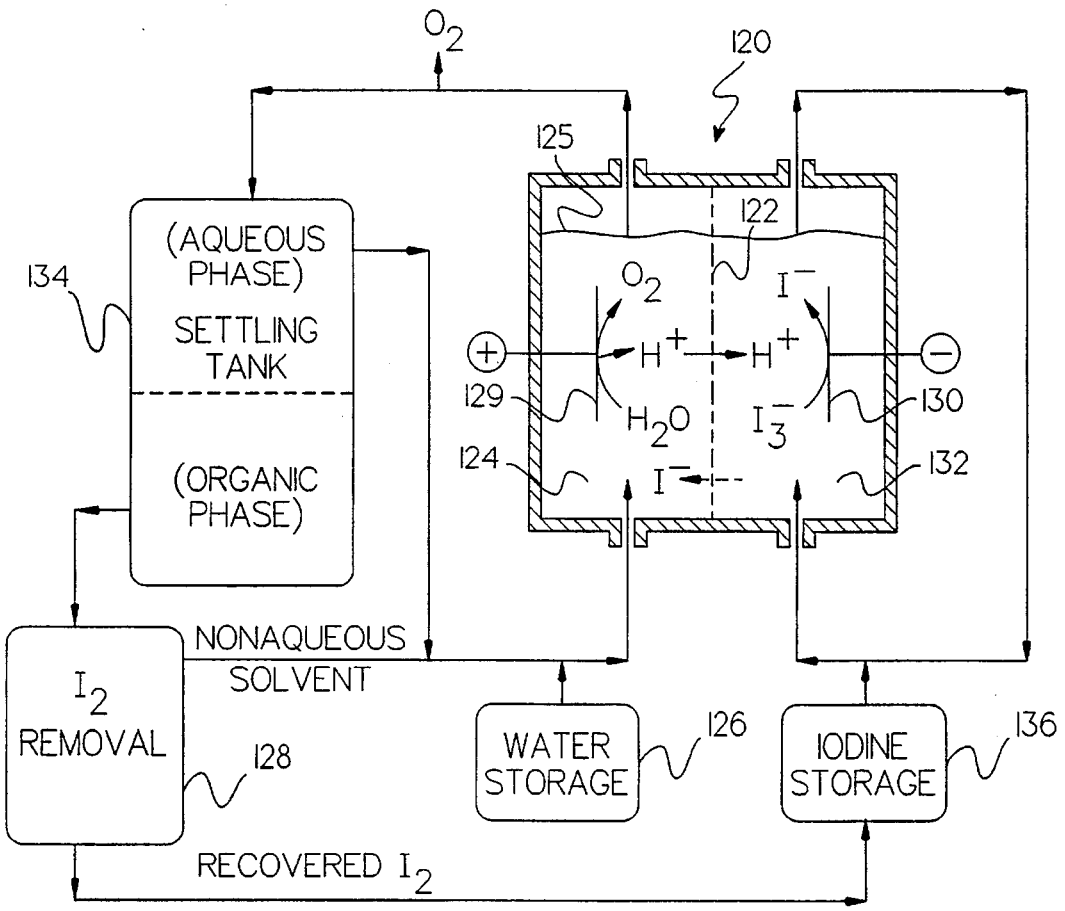
FIG. 5 is a diagrammatic view of an alternative system for the electrochemical synthesis of hydrogen iodide employing a multi-phase aqueous/non-aqueous anolyte.

FIG. 5 illustrates yet a further embodiment of the invention for the production of high purity hydrogen iodide in a two compartment membrane divided electrolysis cell system by either batch, semi-continuous or continuous modes of operation. Electrochemical cell 120 includes a permselective cation exchange membrane 122, such as Nafion 350 brand membrane from E. I. DuPont. Anolyte compartment 124 is charged with a dual phase aqueous/non-aqueous acidified electrolyte 125 consisting of about equal amounts of water from supply 126 and solvent supply/evaporator 128 providing the non-aqueous phase. An acid, such as iodic acid or periodic acid is used as the preferred non-contaminating current conducting electrolyte. The solvent supply may comprise any electrochemically stable organic solvent capable of solubilizing iodine solids forming in electrolyte 125. Halogenated organic solvents are particularly preferred, such as methylene dichloride, ethylene dichloride and trichloroethylene. Solvent mixtures are also useful.

With application of a voltage across anode 129 and cathode 130 water from the immiscible dual phase electrolyte generates protons and oxygen at the anode, two useful anode products. Solubilized iodine in catholyte compartment 132 is reduced at cathode 130 to form iodide ions. Protons transporting across membrane 122 enter catholyte compartment 132 and combine with iodide to form a solution of HI. Iodide ions back migrating from catholyte compartment 132 through the membrane and into the anolyte compartment become oxidized to iodine at the anode. Any iodine solids developing in the anolyte compartment are promptly solubilized by the non-aqueous organic solvent phase of the dual phase liquid. Periodically, anolyte liquor 125 is withdrawn from the cell and recycled to settling tank 134 where the dual phase anolyte liquor is allowed to settle and undergo phase separation. The denser lower organic phase is withdrawn from tank 134 and treated in solvent supply/evaporator 128 where iodine laden organic solvent is stripped of iodine and clean solvent made available for recycling back to the anolyte compartment. Iodine separated from the organic solvent is recycled back to iodine supply vessel 136 for use in preparing iodine-containing catholyte.

The following specific examples demonstrate the various embodiments of the invention, however, it is to be understood they are for illustrative purposes only and do not purport to be wholly definitive as to condition and scope.

EXAMPLE I

The production of high purity hydrogen iodide was demonstrated in a laboratory scale electrochemical cell according to the following protocol:

The experiment was performed in an MP Flow Cell from ElectroCell AB (Sweden). The cell was operated in a two compartment configuration utilizing a Nafion® 350 perfluorosulfonic acid cation exchange membrane as the separator. The anode was an oxygen evolving anode from ElectroCell AB while the cathode was a high surface area type having the designation GF-S6 graphite felt supplied by The Electrosynthesis Company, Inc., Lancaster, N.Y. The graphite felt cathode was ¼ inch thick and was pressed against a Union Carbide ATJ graphite backplate for electrical connection. The projected electrode area was 200 $cm^2$. A constant current of 50 Amps was supplied to the cell by an ESC 710 power supply from The Electrosynthesis Company, and the charge passed was monitored by an ESC 640 Digital Coulometer. The solutions were circulated through the cell with March MDK-MT3 sealless magnetic drive pumps at a flow rate of 1.2 gallons/minute. The anolyte and catholyte were recirculated through the cell from 2 L glass reservoirs so that the experiment was performed in a batch mode.

The anolyte was one liter of a 1.4 molar solution of iodic acid in water and the catholyte consisted of 2.44 moles of iodine crystals solubilized in 500 ml of 55% aqueous HI. Water was added to the catholyte so that the total start volume was 743 ml. Halfway through the experiment 0.5 moles of additional iodine was added to the catholyte. The experiment was conducted at a temperature of 50° C. After the passage of 671,000 coulombs of charge, the solubilized catholyte iodine concentration had been depleted from a starting concentration of 3.28 molar to a final concentration of 0.018 molar, and the HI concentration increased from 3.61 to 7.28 molar providing a current efficiency of 95% for HI production. The HI was free of contaminating anions. The cell voltage for the experiment was between 3.3 and 3.7 volts.

In a further experiment performed with the MP Cell fitted with a high surface area GF-S6 graphite felt cathode additional electrolysis demonstrated the removal of solubilized iodine from the HI catholyte to a final concentration of 0.004 molar. The current density in this experiment was 200 $mA/cm^2$ and the current efficiency for HI production was greater than 90 percent.

During the experiment periodic acid was formed in the anolyte at a current efficiency of 16%. The major anode reaction was oxygen production. The anolyte at first turned to an orange color due to the oxidation of diffused iodide ion to iodine by iodate ion, but then returned to a colorless condition indicating that iodide ion diffusing through the membrane into the anolyte was oxidized to iodate ion by periodate ion being formed at the anode.

Generally, this example demonstrates that high purity, high concentration HI suitable for commercial use can be produced directly in an electrochemical cell without iodine solids developing, thereby causing fouling and blocking with the result of decreased cell performance, and without trade offs in cell performance as measured by current efficiency, which remained high. That is, the experiment demonstrated the effectiveness of iodic/periodic acids in the anolyte in preventing the formation and precipitation of iodine in the anolyte compartment. The experiment also demonstrated the performance of high surface area cathodes in the efficient removal of solubilized iodine to low levels at high current efficiencies and at high current densities.

EXAMPLE II

A second experiment is conducted to demonstrate a further embodiment of the invention. A three compartment electrochemical cell, namely an Electro-Cell MP brand cell is fitted with a DSA-$O_2$ anode and a high surface area type GF-S6 graphite felt cathode. The catholyte compartment is separated from the central compartment by an anion exchange membrane such as those manufactured by Tosoh Corp., based on fluorinated polymers are stable to HI and iodine and which minimizes proton leakage into the catholyte. The anolyte is separated from the central compartment by a Nafion 350 perfluorinated cation exchange membrane.

The catholyte is an aqueous HI solution containing a low level of solubilized iodine. Iodine is periodically fed during the experiment into the catholyte to maintain its concentration. When current is passed, iodide ions formed by the reduction of iodine at the cathode are transported across the anion exchange membrane into the central compartment, but are largely prevented from entering the anolyte compartment by the cation exchange membrane. The anolyte is an aqueous solution of iodic acid and periodic acid at concentrations to provide adequate conductivity. Protons, oxygen and a small amount of periodate ions are formed at the anode when current is passed. Protons are transported towards the cathode under the influence of the potential gradient and cross the cation exchange membrane into the central compartment where they combine with iodide to form HI. Iodide ions back migrating into the anolyte are oxidized to soluble iodate ions by periodate ions formed at the anode.

This example demonstrates that HI may be produced in a three compartment electrochemical cell using both anion and cation exchange membranes. The HI product is very low in contaminating anions and may be distilled to obtain the final desired concentration. The use of low concentrations of iodine in the catholyte is permitted because the high surface area cathode effectively reduces iodine efficiently at low concentrations. The low concentration of solubilized iodine in the catholyte also results in minimal diffusion of solubilized iodine into the final HI product. Iodine precipitation and buildup in the anolyte compartment are prevented by using iodic/periodic acids as the anolyte.

EXAMPLE III

A third experiment is conducted to demonstrate an embodiment of the invention whereby hydrogen iodide is produced in a three compartment electrochemical cell but equipped with two cation exchange membranes. A three compartment ElectroCell MP cell is fitted with a DSA-$O_2$ anode and a high surface area type GF-S6 graphite felt cathode. The catholyte is separated from the central compartment by a Nafion 350 perfluorinated cation exchange membrane. The anolyte is also separated from the central compartment with the same type of cation exchange membrane. The central compartment is filled with a flush stream consisting of dilute aqueous HI maintained at a concentration of less than 25% of the catholyte HI concentration.

The catholyte compartment contains iodine solubilized in a solution of aqueous HI. Iodine is reduced to iodide ions through the use of a high surface area cathode of the type described in the prior examples for efficient reduction to low iodine levels. The anolyte liquor consists of an aqueous solution of sulfuric acid. Protons and oxygen are formed from the oxidation of water at the anode. Protons migrate under the influence of the potential gradient first into the central compartment and then into the catholyte compartment to form HI. Any iodide ions diffusing from the catholyte compartment enter the central flush stream where iodide concentrations are maintained at low levels such that diffusion of iodide ions into the anolyte is minimized and the anolyte concentration of iodine does not build up to levels where iodine precipitates. Likewise, any sulfate ions from the sulfuric acid diffusing from the anolyte enters the flush stream and is present at such low concentrations that diffusion of sulfate ions into the catholyte compartment is minimized. Hydrogen iodide which builds up slowly in the flush stream due to the diffusion of iodide is recovered by distillation.

This experiment demonstrates that high purity HI may be produced in an electrochemical cell using dual cation exchange membranes and a flush stream. The flush stream substantially prevents contamination of the HI product in the catholyte by anions diffusing from the anolyte compartment while preventing the build up and precipitation of iodine in the anolyte compartment. This experiment also demonstrates that non-oxidizing acids may be employed with a three compartment electrochemical cell when used in conjunction with a flush stream which largely prevents diffusion of iodide ions into the anolyte compartment and largely prevents foreign anions from the anolyte compartment from diffusing into the catholyte compartment and contaminating the HI.

EXAMPLE IV

High purity hydrogen iodide can also be produced electrochemically in an undivided, single compartment cell fitted with a gas diffusion electrode according to the following procedure.

An undivided ElectroCell MP Cell is fitted with a hydrogen consuming anode such as those manufactured by E-TEK Corp., Boston, Mass., for efficient oxidation of hydrogen to form protons, and a high surface area type GF-S6 graphite felt cathode for the reduction of an electrolyte comprising aqueous iodine solubilized in HI to form iodide ions. Hydrogen is fed to the dry or gas side of the anode. The high surface area cathode permits reduction of solubilized iodine in the electrolyte to very low concentrations. Iodide formed at the cathode combines with protons formed at the anode to produce HI. Electrolysis is continued until the HI product is sufficiently low in solubilized iodine.

Example IV demonstrates the usefulness of hydrogen depolarized anodes in the electrochemical synthesis of HI in a cell without requiring the customary cell divider, e.g., ion exchange membrane. Elimination of the cell separator also provides for operation of the cell at savings of at least 1 volt compared to cells fitted with such membranes. The low anode potential provides that reoxidation of iodide at the anode does not occur. Finally, since there is no separate anolyte liquor, and hence no foreign ions present, the hydrogen iodide product is of high purity.

EXAMPLE V

The problem of precipitation of crystalline iodine in the anolyte compartment can also be circumvented by providing a two phase anolyte in which the organic phase solubilizes iodine and the aqueous phase provides sufficient ionic conductivity.

The experimental conditions described in Example I are used, except that the anode and membrane form a solid polymer electrolyte composite in which platinum is deposited on the membrane and the anolyte consists of 250 ml of ethylene dichloride and 500 ml of water, intimately mixed. As electrolysis proceeds portions of the anolyte (about 250 ml) are removed, the phases allowed to separate in a reservoir, and the highly iodine colored organic phase distilled. The purified ethylene dichloride is returned to the anolyte stream and recovered iodine is added to the catholyte solution for further reduction to HI. Instead of the batch type operation described here, continuous operation is also possible using equipment and methods outlined in FIG. 1.

Thus, use of two phase anolyte mixture avoids iodine precipitation, fouling of cell components and plugging of piping. Furthermore, use of a solid polymer electrolyte composite of anode and membrane permits use of water as the anolyte.

While the invention has been described in conjunction with various embodiments, they are illustrative only. Accordingly, many alternatives, modifications and variations will be apparent to persons skilled in the art in light of the foregoing detailed description, and it is therefore intended to embrace all such alternatives and variations as to fall within the spirit and broad scope of the appended claims.

We claim:

1. A method of producing hydrogen iodide electrochemically, which comprises the steps of:

(i) providing a compartmentalized electrochemical cell having an anode in an anolyte compartment and a cathode in a catholyte compartment;

(ii) introducing into said catholyte compartment an aqueous electrolyte comprising solubilized iodine;

(iii) introducing into said anolyte compartment an aqueous solution comprising an oxidizing agent capable of oxidizing back migrating iodide ions to a soluble iodine species without the production of cell fouling amounts of iodine;

(iv) impressing a voltage across said anode and cathode to produce at least protons in the anolyte compartment, and hydrogen iodide in the catholyte compartment.

2. The method of claim 1 wherein the aqueous solution of step (iii) comprises an oxidizing agent selected from the group consisting of halogenated oxidizing acid, non-halogenated peracid, hydrogen peroxide, ozone, and mixtures thereof.

3. The method of claim 1 wherein the oxidizing agent of the aqueous solution of step (iii) comprises a halogenated oxidizing acid selected from the group consisting of iodic, periodic, bromic, chloric, perchloric acids and mixtures thereof.

4. The method of claim 1 wherein the oxidizing agent of the aqueous solution of step (iii) comprises a halogenated oxidizing acid selected from the group consisting of iodic acid, periodic acid and mixtures thereof.

5. The method of claim 4 wherein both hydrogen iodide and periodic acid are simultaneously produced as electrolysis products.

6. The method of claim 1 wherein the anolyte and catholyte compartments of the compartmentalized electrochemical cell of step (i) are separated by a porous separator and hydrostatic pressure on said aqueous solution in the anolyte compartment is increased relative to the hydrostatic pressure in the catholyte compartment, or the hydrostatic pressure on said solution in the catholyte compartment is decreased relative to the hydrostatic pressure in the anolyte compartment.

7. The method of claim 1 wherein the anolyte and catholyte compartments of the compartmentalized electrochemical cell of step (i) are separated by an ion-exchange membrane.

8. The method of claim 6 wherein the cathode is a high surface area cathode.

9. The method of claim 8 wherein the high surface area cathode is comprised of carbon.

10. The method of claim 9 wherein the carbon cathode is comprised of a high surface area graphite felt.

11. The method of claim 6 wherein the cathode is a solid graphite plate.

12. The method of claim 6 wherein the anode is a member selected from the group consisting of noble metal-containing anode, dimensionally stable anode, graphite-containing anode, substoichiometric titanium oxide-containing anode and lead oxide-containing anode.

13. The method of claim 7 wherein the ion-exchange membrane is a cation exchange permselective membrane.

14. The method of claim 13 wherein cation exchange permselective membrane is a perfluorosulfonic acid membrane.

15. The method of claim 13 wherein the membrane and anode of the electrochemical cell are in the configuration of a solid polymer electrolyte composite, and the anode comprises a material selected from the group consisting of a noble metal, noble metal oxide and lead oxide.

16. The method of claim 7 wherein the membrane and at least one of the electrodes of said electrochemical cell are formed into a solid polymer electrolyte composite.

17. The method of claim 1 wherein the anode is a hydrogen depolarized anode.

18. The method of claim 1 wherein HI is produced in a continuous or semi-continuous mode.

19. The method of claim 14 wherein the continuous mode is performed by the steps of distilling HI from the catholyte, and condensing the vapor to form a distillate rich in HI.

20. The method of claim 18 wherein the continuous or semi-continuous mode is performed by the steps of removing a solution of HI from the catholyte of the compartmentalized electrochemical cell, and further electrolyzing said removed solution in a secondary polishing cell to convert a substantial portion of the residual solubilized iodine to HI.

21. A method of producing hydrogen iodide electrochemically, which comprises the steps of:

(i) providing a three compartment electrochemical cell having an anode in an anolyte compartment, a cathode in a catholyte compartment, and a central compartment disposed between said anolyte and catholyte compartments, said electrochemical cell having a cation exchange membrane separating said anolyte and central compartments and a anion exchange membrane separating said catholyte and central compartments;

(ii) introducing into said catholyte compartment an aqueous solution comprising solubilized iodine;

(iii) introducing into said anolyte compartment an aqueous solution comprising an oxidizing agent capable of oxidizing back migrating iodide ions to a soluble iodine species without the production of cell fouling amounts of iodine;

(iv) introducing into said central compartment an aqueous solution of an electrolyte comprising HI, and (v) impressing a voltage across said anode and cathode to produce iodide ions at the cathode and protons at the anode, the iodide ions from the catholyte and protons from the anolyte passing through their respective membranes into said central compartment to form high purity hydrogen iodide.

22. The method of claim 21 wherein the aqueous solution in the anolyte compartment of step (iii) comprises an oxidizing agent selected from the group consisting of halogenated oxidizing acid, hydrogen peroxide, ozone, non-halogenated peracid and mixtures thereof.

23. The method of claim 22 wherein the concentration of solubilized iodine in the catholyte compartment is at levels sufficiently low to minimize transport of solubilized iodine to the central compartment.

24. A method of producing hydrogen iodide electrochemically, which comprises the steps of:

(i) providing a three compartment electrochemical cell having an anode in an anolyte compartment, a cathode in a catholyte compartment, and a central compartment disposed between said anolyte and catholyte compartments, said anolyte and catholyte compartments being separated from said central compartment by first and second spaced cation exchange membranes;

(ii) introducing into said catholyte compartment an aqueous electrolyte solution comprising solubilized iodine;

(iii) introducing into said anolyte compartment an aqueous solution comprising an oxidizing agent in an amount at least sufficient to chemically oxidize back migrating iodide ions from the central compartment, said oxidizing agent selected from the group consisting of halogenated oxidizing acid, non-halogenated peracid, hydrogen peroxide, ozone, and mixtures thereof;

(iv) introducing into said central compartment an aqueous electrolyte solution comprising HI, and (v) impressing a voltage across said anode and cathode to produce iodide ions at the cathode and protons at the anode, said protons passing through said first cation exchange membrane into the central compartment and through said second cation exchange membrane into the catholyte compartment to react with the iodide ions therein to form high purity hydrogen iodide without cell fouling amounts iodine being produced.

25. The method of claim 24 wherein the central compartment of the electrochemical cell receives protons from the anolyte compartment and iodide ions from the catholyte compartment as a flush solution of HI, the HI in the central compartment maintained at a lower concentration than the concentration of HI in the catholyte compartment.

26. The method of claim 24 wherein the aqueous solution of the anolyte of step (iii) comprises an acidic electrolyte selected from the group consisting of oxidizing acids and non-oxidizing acids.

27. A method of producing hydrogen iodide electrochemically, which comprises the steps of:

(i) providing an undivided electrochemical cell having a cathode and a hydrogen depolarized anode;

(ii) introducing into the electrochemical cell an electrolyte comprising solubilized iodine;

(iii) providing a voltage source for said anode and cathode to produce iodide ions at said cathode, and (iv) feeding a source of hydrogen to said hydrogen depolarized anode to form protons for reacting with the iodide ions.

28. The method of claim 27 wherein said hydrogen depolarized anode comprises a dry side and a wet side, and HI formed is removed from the electrochemical cell on the wet side of said anode.

29. The method of claim 27 wherein the electrochemical cell is operated electrogeneratively.

30. A method of producing hydrogen iodide electrochemically, which comprises the steps of:

(i) providing a membrane divided electrochemical cell having an anode in an anolyte compartment and a cathode in a catholyte compartment;

(ii) introducing into said catholyte compartment an aqueous electrolyte comprising solubilized iodine;

(iii) introducing into said anolyte compartment a liquid comprising an aqueous phase and a non-aqueous phase having an electrochemically stable, iodine solubilizing organic solvent;

(iv) impressing a voltage across said anode and cathode to produce iodide ions at the cathode and protons at the anode, and (v) forming hydrogen iodide in the catholyte compartment from protons from the anolyte compartment passing through said membrane and reacting with iodide ions without crystalline iodine forming in the anolyte compartment.

31. The method of claim 30 wherein the organic solvent of the non-aqueous phase in the anolyte compartment is a halogenated organic solvent.

32. The method of claim 31 including the steps of withdrawing at least a portion of the aqueous and nonaqueous phases from the anolyte compartment; allowing said aqueous phase and non-aqueous phase to form separate layers, recovering crystalline iodine from said non-aqueous phase and returning the iodine depleted non-aqueous phase and aqueous phase liquid to the anolyte compartment.

33. The method of claim 30 wherein the membrane of said electrochemical cell of step (i) is a perfluorosulfonic acid type cation exchange membrane.

34. The method of claim 33 wherein the anode and cation exchange membrane comprise a solid polymer electrolyte composite.

35. The method of claim 31 wherein said organic solvent is a member selected from the group consisting of methylene dichloride, ethylene dichloride and trichloroethylene.

* * * * *